US006130373A

United States Patent [19]

Hall

[11] Patent Number: 6,130,373

[45] Date of Patent: Oct. 10, 2000

[54] TUNABLE SUSPENSION STRING TREE

[76] Inventor: Brian W. Hall, 52 Ann La., Hampton, N.H. 03842

[21] Appl. No.: 09/484,758

[22] Filed: Jan. 18, 2000

Related U.S. Application Data

[63] Continuation of application No. 09/228,912, Jan. 11, 1999, Pat. No. 6,040,511.

[51] Int. Cl.[7] ..... G10D 3/14

[52] U.S. Cl. ..... 84/312 R; 84/454; 84/455

[58] Field of Search ..... 84/312 R, 312 P, 84/454, 455

[56] References Cited

U.S. PATENT DOCUMENTS

| | | | |
|---|---|---|---|
| 3,000,253 | 9/1961 | Houde | 84/312 R |
| 4,171,661 | 10/1979 | Rose | 84/313 |
| 4,724,737 | 2/1988 | Fender | 84/313 |
| 4,882,967 | 11/1989 | Rose | 84/313 |
| 4,939,971 | 7/1990 | Satoh | 84/313 |
| 4,967,631 | 11/1990 | Rose | 84/313 |
| 5,373,769 | 12/1994 | Sherman | 84/313 |
| 5,413,019 | 5/1995 | Blanda, Jr. | 84/298 |
| 5,551,329 | 9/1996 | Iovare | 84/313 |
| 5,747,713 | 5/1998 | Clement | 84/313 |

*Primary Examiner*—Paul Ip
*Assistant Examiner*—Shih-yung Hsieh
*Attorney, Agent, or Firm*—Bourque & Associates, P.A.

[57] ABSTRACT

A system and method of balancing the torque applied to a stringed instrument's neck and headstock that allows the stringed instrument's neck and headstock to deflect evenly when a tremolo device included in said stringed instrument is operated is provided. The system includes a suspension string tree, which passes over each of the instrument strings at the instrument headstock intermediate a string nut and the tuning machines. The suspension string tree includes two adjustable fasteners, which pass through the string tree at opposite ends thereof and which adjustably retain the suspension string, tree to the headstock at a desired distance and vertical angle with respect to the headstock. The method includes balancing the torque applied to a stringed instrument's neck and headstock by the instrument's strings by adjusting adjustment fasteners located at opposite ends of, and which adjustably retain, a suspension string tree that passes over all of the instrument strings to an instrument headstock. The balancing is performed by tuning the instrument to pitch and then operating the tremolo device. The tremolo device operation is followed by adjusting the adjustment fasteners inwardly and outwardly to return the two outer strings to their proper pitches.

10 Claims, 6 Drawing Sheets

TUNABLE SUSPENSION STRING TREE

RELATED APPLICATIONS

This is a continuation in part of U.S. patent application Ser. No. 09/228,912, filed Jan. 11, 1999 now U.S. Pat. No. 6,048,571.

BACKGROUND

In 1954, Leo Fender developed a tremolo device to be-included on the new Fender® Stratocaster® guitar. Leo Fender's tremolo device was the subject matter of U.S. Pat. No. 2,741,146, which is incorporated herein by reference. The purpose of a tremolo system is to provide a system that allows the guitar string tension, which provides the desired pitch of each string, to be altered. The result is that the pitch of the guitar strings may be varied, to either a lower pitch (flat) or a higher pitch (sharp) . The lower and higher pitch variations are provided by, respectively loosening and tightening the guitar string tension.

In simplified terms, the Fender Stratocaster tremolo system includes a movable bridge, which rocks on a fulcrum to reduce and increase string tension. The bridge is biased in a normal position by a series of springs, which counteract the forces applied by string tension. A first end of each spring is attached to the bridge while the opposite end of each spring is rigidly attached to the guitar body.

The simplicity of the Stratocaster-type spring-loaded tremolo system has resulted in the widespread copying of the system for use in countless numbers of copies of the Fender Stratocaster, which are manufactured and sold each year. In fact, the Fender Stratocaster is the single most copied guitar sold around the world. Additionally, the basic design of the Fender Stratocaster-type tremolo system has been applied to countless other electric guitars manufactured and sold by a vast number of guitar manufacturers.

However, even though the Fender Stratocaster and similar guitars that incorporate the Fender Stratocaster-type tremolo system design are in widespread production and use throughout the world, the Stratocaster-type tremolo device incorporates a fundamental design flaw, which results in the inability for guitars using this type of tremolo system to remain in tune if the tremolo system is utilized by the guitarist.

A number of prior art devices have been provided to rectify the tendency of Stratocaster-type guitars to go out of tune. However, all of the prior art systems have addressed the tremolo device itself and have provided systems that accurately reposition the tremolo block to its original position. Although the prior art systems do provide somewhat better tuning stability than the original Stratocaster-type tremolo device, none of the prior art systems are totally effective.

Accordingly, what is needed is a system and method that can ensure that a tremolo-equipped guitar, such as a Fender Stratocaster-type guitar can remain in tune, even under repeated, severe operation of its tremolo device.

SUMMARY OF THE INVENTION

The disclosed invention overcomes these and other limitations by providing a system and method of balancing the up-pressure applied to the guitar's tuning machines, which allows the guitar neck and headstock to relax and deflect evenly when a guitar tremolo device is operated. Accordingly, since neck and headstock twisting is substantially eliminated, the guitar will return to pitch even under repeated, sever tremolo device operation.

The system includes a suspension string tree, which passes over each of the guitar strings at the guitar headstock intermediate the guitar nut and the tuning machines. The suspension string tree is preferably angled with respect to the orientation of the guitar nut. The suspension string tree also includes two adjustment screws, which pass through the string tree at opposite ends thereof and which adjustably retain the suspension string tree to the headstock.

The method includes balancing the up-pressure applied to the guitar tuning machines by the guitar strings by adjusting adjustment screws located at opposite ends of and which adjustably retain a single linear suspension string tree that passes over all of the guitar strings to a guitar's headstock. The balancing is performed by tuning the guitar to pitch and then operating the guitar tremolo device. The tremolo device operation is followed by adjusting the adjustment screws inwardly and outwardly to return the two outer strings (the high E and low E strings) to their proper pitches. The tremolo operation and adjustment screw adjustment steps may be performed multiple times to ensure that the up-pressures applied to the tuning machines are substantially balanced.

DESCRIPTION OF THE DRAWINGS

These and other features of the present invention will be more fully understood by reading the following detailed description, taken together with the drawings, wherein.

DESCRIPTION OF THE INVENTION

Figure 1:
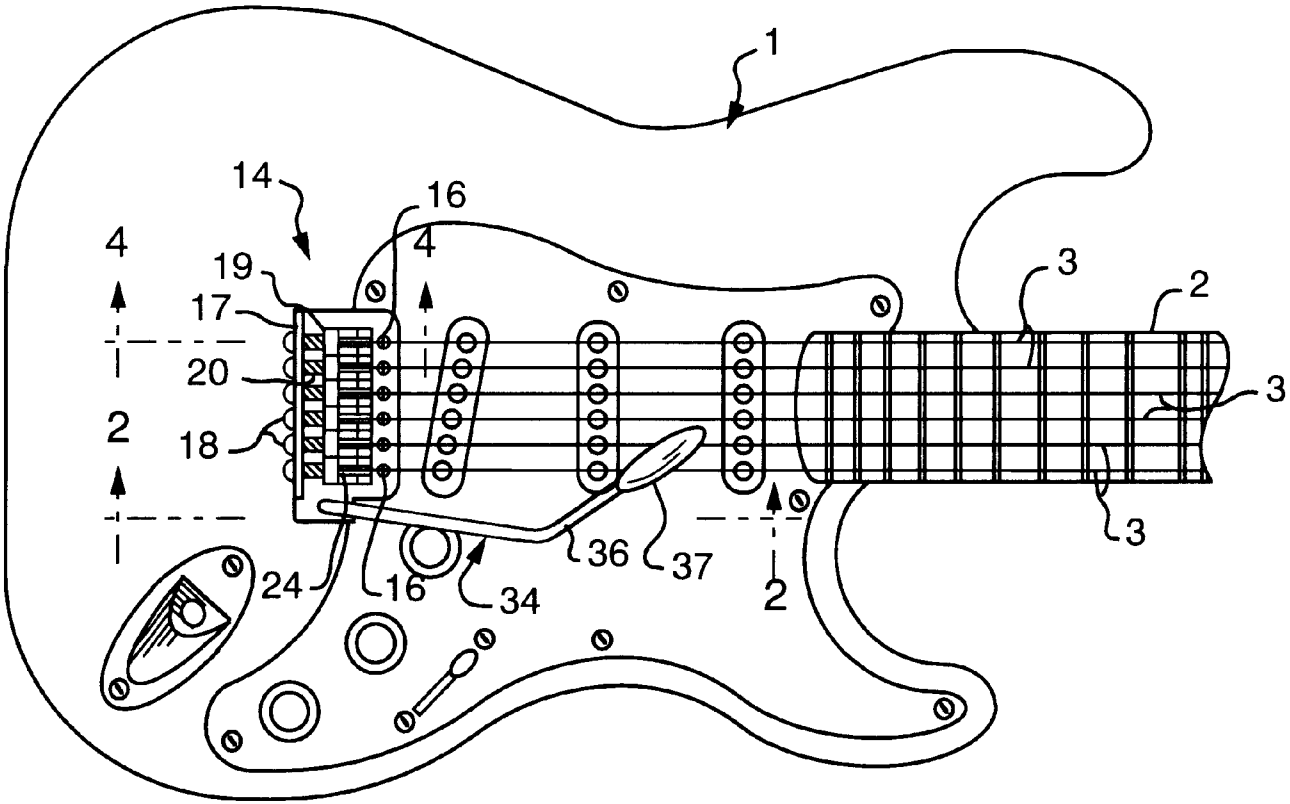
FIG. 1 (PRIOR ART)
FIG. 1 is a top view of a prior art Stratocaster-type guitar, which includes a prior art Stratocaster-type, spring-loaded tremolo device, according to the teaching of U.S. Pat. No. 2,741,146.
Figure 4:
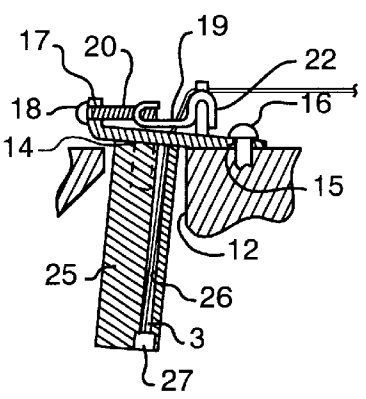
FIG. 4 (PRIOR ART)
FIG. 4 is a sectional side view of the prior art tremolo device of FIG. 1.
Figure 3:
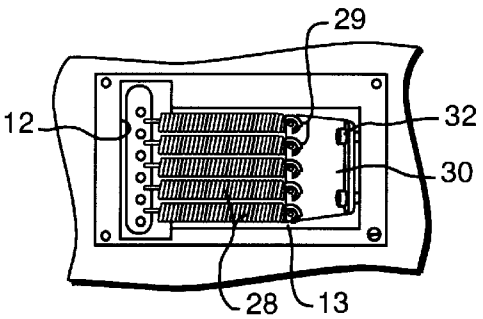
FIG. 3 (PRIOR ART)
FIG. 3 is a bottom view of the prior art tremolo device of FIG. 1.
Figure 2:
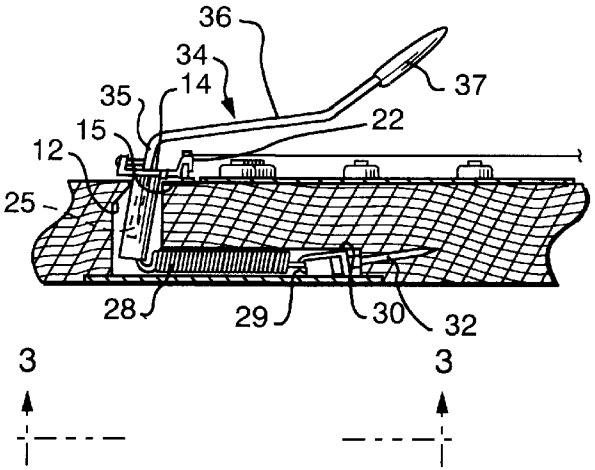
FIG. 2 (PRIOR ART)
FIG. 2 is a sectional side view of the prior art tremolo device of FIG. 1.

The basic, Stratocaster-type, spring-loaded tremolo device according to the teachings of U.S. Pat. No. 2,741,146 is shown in FIGS. 1–6. Although the Stratocaster-type tremolo device has evolved slightly over the years, the basic principles of its construction and operation have remained substantially since its invention in 1954 until the present.

The guitar includes a body 1, from which extends a neck 2 terminating in a headstock 58. The headstock 58 includes a plurality of guitar string tuning machines 56, which are used to adjust the tension on the guitar strings 3 to provide desired string pitch. Strings extend from a bridge, which will be more fully described below, over the body and neck.

Formed in the body 1 is a transverse slot 12, which communicates at the under side of the body with a recess 13 directed toward the neck 2. Mounted on the body 1 adjacent the slot 12 is a base plate 14, one edge of which is beveled to form a fulcrum ridge 15. The beveled edge of the base plate 14 is secured to the body 1 by screws 16, which permit limited pivotal movement of the base plate about the fulcrum 15. The fulcrum is located forwardly of the slot 12, that is toward the neck 2.

The base plate 14 overlies and covers the slot 12 and is provided at its rear edge with an upturned flange 17. Tension screws 18, one for each string 3, extend forwardly through the flange 17 and are screw threaded into sectional bridge elements 19. Springs 20 are interposed between the bridge elements 19 and the flange 17.

Secured to the inner side of the base plate 14 is a bar 25 which extends into the slot 12. The bar is provided with a plurality of vertically extending bores 26, one for each string 3. Each string passes over a corresponding bridge element 19, through a slot 24 in each bridge element 19 and into the corresponding bore through a registering hole in the base plate 14. The extremity of each string is provided with an anchor element 27, which seats in an enlarged portion of a counterbore formed at the lower extremity of the corresponding bore 26.

Secured to the lower extremity of the bar 25 are a plurality of tension springs 28. These springs extend forwardly within the recess 13 and are relatively stiff. The forward extremities of the tension springs are retained by hooks 29 formed along a rear edge of a tension plate 30. The tension plate has a flange 31 at its forward edge, which receives screws 32 adapted to be driven into the body at the forward extremity of the recess 13.

One lateral edge of the base plate 14 and bar 25, preferably the edge which constitutes the lower side of the instrument when in the playing position, is extended and receives a control arm 34. The control arm includes a vertical portion 35, which journals in the bar 25 and a laterally directed portion 36 terminating in a handle 37. In the normal playing position, the handle 37 is disposed above and slightly below the strings 3 so as to be received in the palm of the guitarist's hand.

In operation, if the handle 37 is not engaged or is held against movement, the guitar is played in a conventional manner and no tremolo effect is observable. However, if the handle 37 is oscillated to and from the body 1 during vibration of any or all of the strings 3, a tremolo effect will be produced by each of the vibrating strings.

The bar 25 is relatively massive, preferably of solid material and the tension springs 28 are preferably quite stiff, so that unless the control arm 34 is manually oscillated there is no tendency for the bar 25 or springs 28 to vibrate when the strings are plucked. The mass of the bar 25 and stiffness of the springs 28 may, however, be maintained at a minimum because of the relatively close coupling of the bridge portions 22 and the fulcrum ridge 15.

Figure 5:
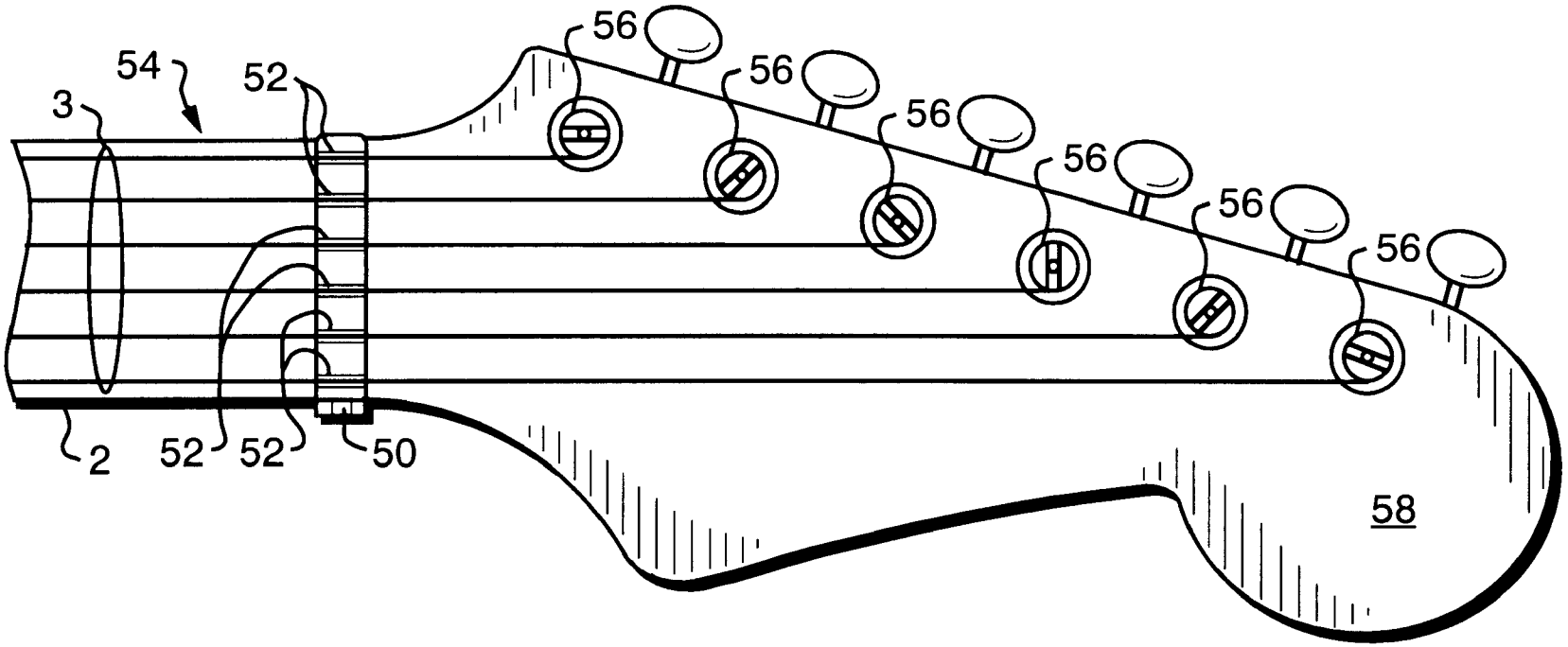
FIG. 5 is a top view of a Stratocaster-type headstock according to the prior art.
Figure 6:
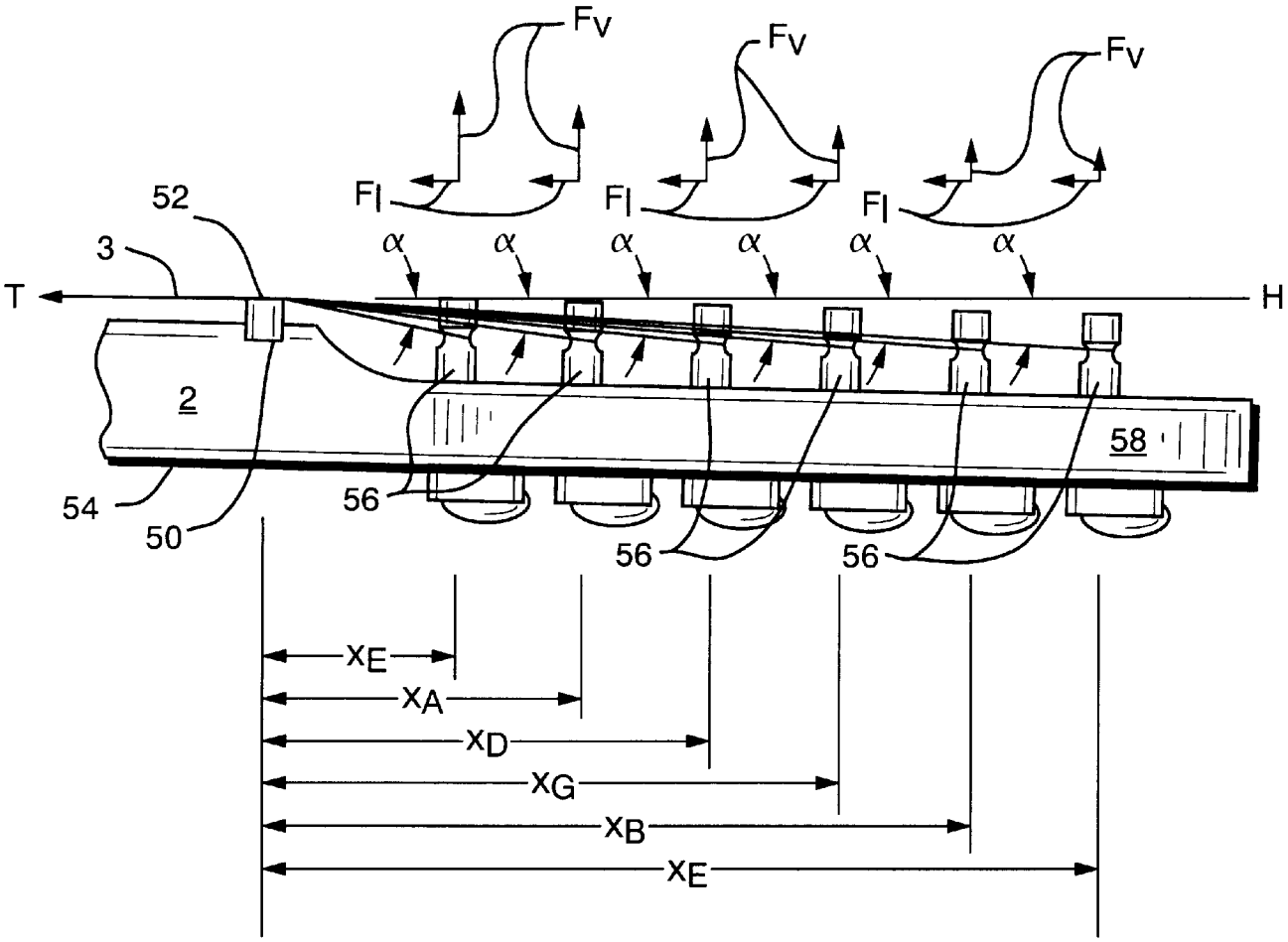
FIG. 6 is a side view of the Stratocaster-type headstock of FIG. 5.

As can be seen more clearly in FIGS. 5 and 6, each guitar string 3 passes through a slot 52 in a nut 50, which is located at the headstock-end 54 of the guitar neck 2, and proceeds to a tuning machine 56. The tuning machines are secured to the guitar headstock 58. As can be seen, each tuning machine is located a different distance from the nut 50. The basic design strategy of this arrangement is to provide straight line travel between the nut slot and tuning machine for each string, which, enhances playability. Since most guitars have six strings, a typical system will include a nut with six string slots and six tuning machines. However, the principles of the present invention are equally applicable to stringed instruments having more or less strings. In addition, as will become more apparent below, the principles of the present invention are also applicable to stringed instrument systems having headstocks with tuning machines on opposite sides thereof, such as guitars manufactured by Gibson® and other manufacturers.

Nonetheless, while the prior art systems and methods of improving the tuning stability of tremolo-equipped guitars have addressed the tremolo device itself, they have all failed to address the true cause of the tuning stability issues. In fact, the root of the problem is not with the tremolo device itself but, rather, with the geometry of the guitar headstock.

As can be seen in FIGS. 5 and 6, since the string slots 52 in the guitar nut 50 are at an elevation that is higher in relation to its effective attachment point on its tuning machine, each guitar string proceeds from the nut 50 to its respective tuning machine 56 at an angle $\alpha$ with respect to the horizontal axis H of the guitar's neck. Since the tuning machines 56 are all at different distances x from the guitar's nut 50, the string angle $\alpha$ for each string will be different. In particular, the string angles will progressively decrease as the strings are traversed from the low E-string to the high E-string (assuming a standard "EADGBE" guitar tuning).

Accordingly, as each string is placed under tension to provide its desired string pitch, there will be a tensile force T pulling on each tuning machine 58. The tensile force T can be resolved into two component forces. First, there will be a component in the longitudinal direction $F_1$. There will also be a corresponding vertical component or up-pressure $F_v$. These component forces will be transferred to the headstock 58, to which the tuning machines 56 are rigidly secured.

The longitudinal forces and up-pressures can be calculated as follows:

$$F_v = T \sin \alpha \text{ and } F_1 = T \cos \alpha,$$

where T is the tension on the guitar string 3.

Since the string angle $\alpha$ for the low E-string will be greater than all the others, even assuming equal tension among the guitar's strings, it will apply the greatest vertical force or up-pressure to the headstock 58. (In reality, each guitar string is at a different tension. For example, for a set, which range in gauge from 0.009 in. to 0.042 in., the string tensions will be substantially 5.94 kg., 4.99 kg., 6.67 kg., 7.17 kg., 7.17 kg., and 6.71 kg., respectively, when the strings are all tuned to a standard EADGBE tuning. Different string gauges will produce different tensions.) As the strings are traversed to the high E-string, as can be seen, the tension applied will have a progressively higher longitudinal component $F_1$ and a progressively lesser vertical component or up-pressure $F_v$.

In addition, also due to the differing distances of the tuning machines 56 from the nut 50, the up-pressure applied to each tuning machine will provide a torque or moment applied to the headstock, which can be calculated as:

$$M = F_v * x,$$

where x is the distance that the tuning machine 56 is from the nut 50. Since each tuning machine will have a different up-pressure and will be a different distance from the guitar's nut, a different moment will be applied by each. Accordingly, the neck and headstock will be slightly twisted.

Thus, when the tremolo device is operated and the strings are de-tensioned, the guitar's neck and, in particular, its headstock will relax to its at-rest, untwisted position. When the strings are re-tensioned by releasing the tremolo control arm, the strings will apply their un-even up-pressures and uneven moments to the neck and its headstock, causing the neck and headstock to twist. However, since the wood that comprises the neck and headstock is relatively thin and flexible when compared to the guitar body and tremolo components, the neck will not be able to return to its initial, twisted position when the guitar is returned to pitch.

However, the disclosed invention substantially eliminates the twisting and untwisting of the neck and its headstock by substantially equalizing the torque or moment applied to the guitar neck by the un-even up-pressures. Thus, when the guitar strings are de-tensioned and re-tensioned, the neck and headstock will relax and return to position evenly. Accordingly, tuning stability is greatly improved and the tuning-related stigma associated with tremolo-equipped instruments will be eliminated.

Tuning stability is accomplished using a suspension string tree 60, which is disposed above each guitar string intermediate the nut 50 and the tuning machines 56. The suspension string tree 60 is adjustably retained to the headstock 58 using two adjustable string tree fasteners 62. The adjustable string tree fasteners 62 are preferably located at opposite ends 64 and 66 of the suspension string tree 60. In the embodiment shown, the string tree fasteners are simple wood screws, which may be alternatively inserted or withdrawn into the guitar's wooden headstock 58. However, alternative fastener systems, such as threaded bushings and machine screws may be utilized to provide better micro-adjustment and system longevity.

In the embodiment shown, the suspension string tree is disposed at a horizontal angle θ with respect to the longitudinal axis L of the guitar's neck and headstock. In one embodiment, the horizontal angle θ is selected in a manner so that the suspension string tree 60 will pass over each string 3 at a point substantially half the distance between the nut 50 and its tuning machine 56. However, the precise angle is not a limitation of the invention as additional horizontal angles may provide the desired results.

In operation, the adjustable string tree fasteners 62 may be tightened or loosened, which raises and lowers a corresponding end of the suspension string tree 60 from the guitar headstock 58, respectively. By adjusting the string tree fasteners, the moment applied by the different up-pressures can be effectively balanced. Thus, the guitar will remain in tune, even under repeated, severe tremolo device operation.

By properly adjusting the suspension string tree 60 using the adjustable string tree fasteners 62 the angle α for each string will be varied. Therefore, each the up-pressure $F_v$ applied to each tuning machine can be adjusted. When the adjustment fasteners are properly adjusted, the up-pressures will be adjusted so that the torque applied to the neck and headstock will be balanced. Thus, when the tremolo device is operated, the guitar headstock 58 will deflect and return to position evenly.

Accordingly the twisting of the headstock under tremolo operation is. substantially eliminated. This allows a guitar utilizing the disclosed invention to remain substantially in tune, even under sever tremolo device operation.

Figure 7:
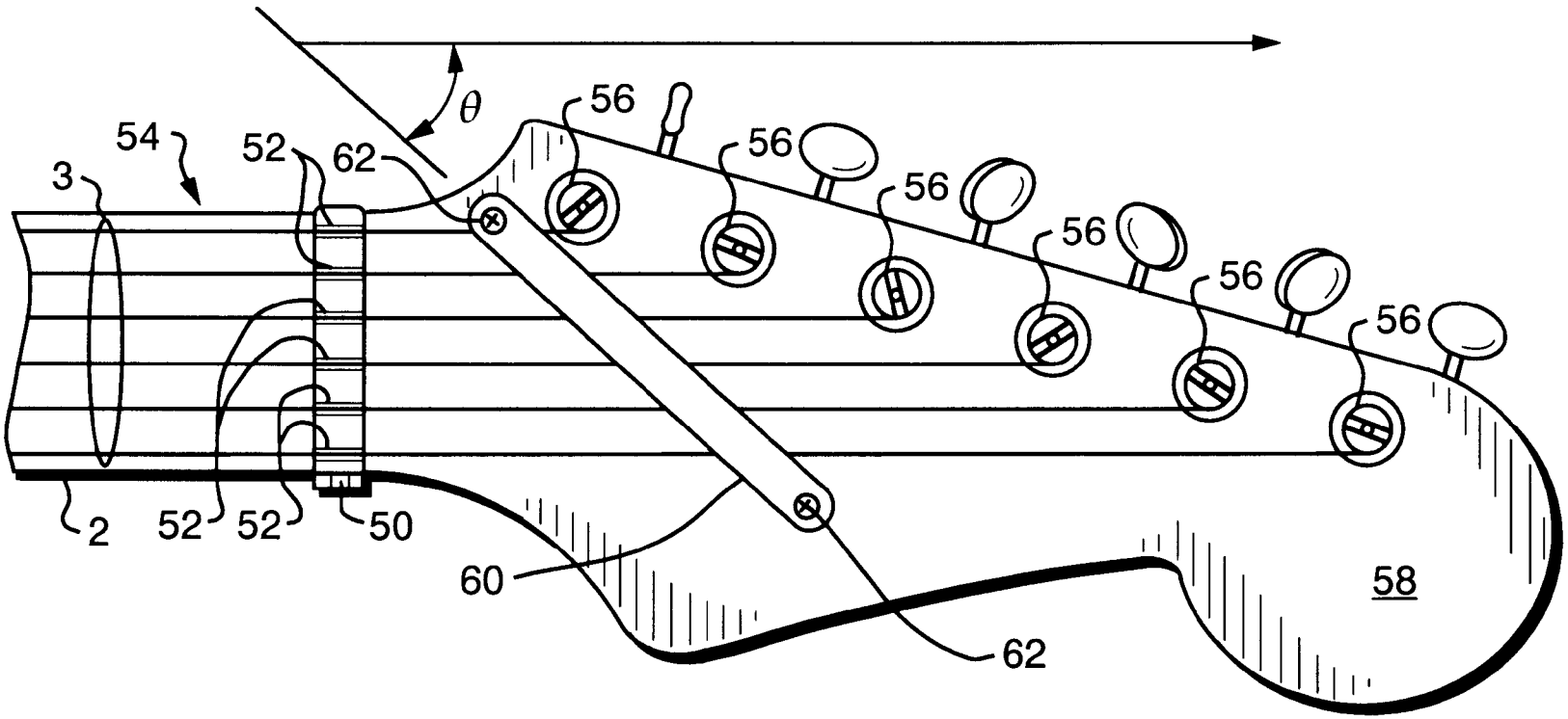
FIG. 7 is a top view of a Stratocaster-type headstock including a suspension string tree according to the present invention.
Figure 8:
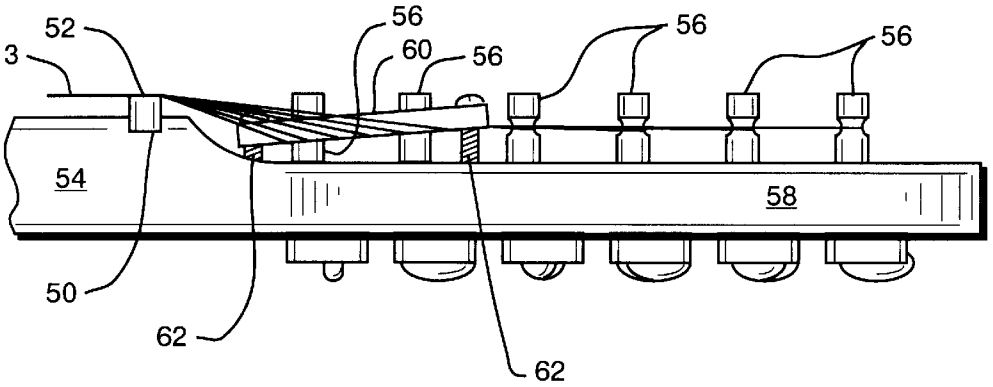
FIG. 8 is a side view of a Stratocaster-type headstock including a suspension string tree according to the present invention.
Figure 9:
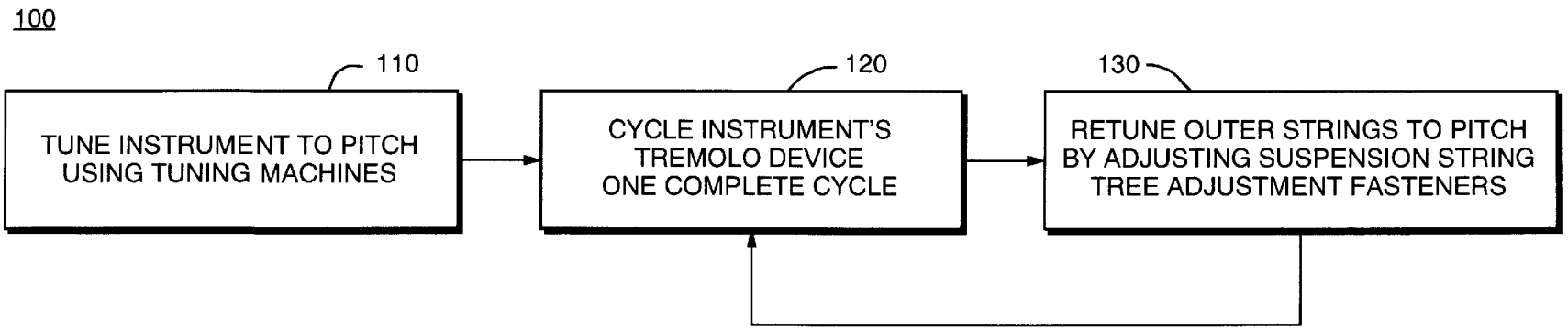
FIG. 9 is a flow chart, which provides the steps of adjusting a suspension string tree to balance the uneven up-pressures applied to the guitar tuning machines according to the teachings of the present invention. tuning a spring-loaded tremolo device according to the teachings of the present invention.

In order to effectively balance the torque applied to the guitar neck and headstock by the up-pressures $F_v$ applied to the tuning machines 56, a tuning stabilizing method 100 (FIG. 7) is provided. The method begins by tuning a stringed instrument to pitch using its tuning machines, step 110. Then, the stringed instrument's tremolo device is operated one complete cycle, step 120. A complete cycle means operating the tremolo control arm to its farthest possible down position to de-tension the tremolo springs as much as possible and allowing the tremolo device to return to position. Since, initially, the torque applied to the neck and headstock by the up-pressures applied to the tuning machines will be different, the guitar headstock will un-twist and re-twist during the first tremolo device cycle. Therefore, when the stringed instrument returns to its neutral position, the headstock will not return to its precise starting position. Accordingly, the strings will not be in tune.

Therefore, the next step, step 130, is to re-tune the two outer guitar strings, which are typically tuned to low and high "E", respectively to their proper pitch by adjusting the suspension string tree adjustment fasteners. Steps 120 and 130 may be repeated a plurality of times to ensure that the up-pressures applied to the tuning machines are precisely balanced. Minor adjustments to the intermediate strings (e.g. the ADGB strings) may also be made using the tuning machines associated with each intermediate string.

While the system and method of the present invention has been described as it is applied to a Fender Stratocaster-type guitar, the system and method of balancing up-pressure is equally applicable to a wide variety of guitars, including bass guitars and guitars employing "three-on-a-side" tuning machine headstock designs. Of course, those skilled in the art will recognize that the principle of the present invention, namely balancing up-pressure applied to tuning machines caused by different string tensions and differing tuning machine distances from a guitar nut, is equally applicable to additional embodiments, which are considered to be within the scope of the present invention.

What is claimed is:

1. A system for balancing torque applied to a plurality of tuning machines on a stringed instrument headstock by a plurality of instrument strings comprising:

a suspension string tree disposed intermediate a stringed instrument nut and said plurality of tuning machines, said suspension string tree passing over each said instrument string;

and at least two suspension string tree adjustment fasteners located at opposite ends of said suspension string tree for adjustably retaining said suspension string tree to said stringed instrument headstock at a desired distance and vertical string tree angle with respect to said headstock.

2. The system of claim 1, wherein said suspension string tree disposed intermediate said stringed instrument nut and said plurality of tuning machines is disposed at a string tree horizontal angle, with respect to said string nut.

3. The system of claim 2, wherein said string tree horizontal angle is selected to position the suspension string tree to pass over each guitar string at a point substantially half the distance from said string nut to each said string's tuning machine.

4. The system of claim 1, wherein said adjustable string tree fasteners comprise wood screws for adjustably retaining said suspension string tree to said instrument headstock.

5. The system of claim 1, wherein said adjustable string tree fasteners comprise threaded bushings and machine screws, for adjustably retaining said suspension string tree to said instrument headstock.

6. In a stringed instrument including a tremolo device, a method of substantially balancing the torque applied to the instruments neck and headstock by a plurality of stringed instrument strings, including two outer strings, on a corresponding plurality of stringed instrument tuning machines disposed on said headstock, said strings passing over a string nut at a headstock end of said neck, said method comprising the steps of:

a) disposing a suspension string tree intermediate said string nut, said suspension string tree passing over each said instrument string;

b) tuning said stringed instrument strings to their desired pitches using said tuning machines;

c) operating said tremolo device one complete cycle; and d) re-tuning said two outer strings to pitch by adjusting said suspension string tree to vary its height and vertical angle with respect to said headstock.

7. The method of claim 6 further comprising repeating steps c and d a plurality of times until said up-pressures applied by said strings to said tuning machines are substantially precisely balanced.

8. The method of claim 7, further comprising the steps of tuning said strings intermediate said two outer strings using said tuning machines associated with each said intermediate string.

9. The method of claim 6, wherein said step of disposing said suspension string tree intermediate said string nut, said suspension string tree passing over each said instrument string comprises disposing said suspension string tree at a horizontal angle with respect to a longitudinal axis of said stringed instrument neck.

10. The method of claim 9, wherein said angle is selected so that said suspension string tree passes over each said instrument string at a point substantially half the distance between said string nut and said tuning machine corresponding to each said string.

* * * * *